US007733357B2

(12) United States Patent
Meados et al.

(10) Patent No.: US 7,733,357 B2
(45) Date of Patent: Jun. 8, 2010

(54) DISPLAY SYSTEM

(75) Inventors: David B Meados, Corvallis, OR (US); David C Collins, Corvallis, OR (US); Andrew Arthur Hunter, Bristol (GB)

(73) Assignee: Hewlett-Packard Development Company, L.P., Houston, TX (US)

( * ) Notice: Subject to any disclaimer, the term of this patent is extended or adjusted under 35 U.S.C. 154(b) by 1183 days.

(21) Appl. No.: 11/331,695

(22) Filed: Jan. 13, 2006

(65) Prior Publication Data

US 2007/0164943 A1 Jul. 19, 2007

(51) Int. Cl.
*G09G 5/10* (2006.01)

(52) U.S. Cl. ..... 345/690

(58) Field of Classification Search ..... 345/690, 345/204, 581, 84, 32, 600, 102; 348/294, 348/333.01, 739, 207.1, 51, 219.1; 382/133, 382/128, 104, 284, 294, 167, 145; 353/28, 353/122, 30, 54, 84; 359/708, 9; 355/32; 250/208.1
See application file for complete search history.

(56) References Cited

U.S. PATENT DOCUMENTS 4,110,790 A 8/1978 Wheeler
4,947,253 A 8/1990 Neal
5,142,365 A 8/1992 Lim et al.
5,483,259 A * 1/1996 Sachs ..... 345/600
5,638,138 A 6/1997 Hickman
5,694,481 A * 12/1997 Lam et al. ..... 382/145
5,768,443 A * 6/1998 Michael et al. ..... 382/294
5,809,161 A * 9/1998 Auty et al. ..... 382/104
5,818,525 A * 10/1998 Elabd ..... 348/268
5,963,276 A * 10/1999 Inbar ..... 349/5
6,062,475 A * 5/2000 Feng ..... 235/462.06
6,069,973 A * 5/2000 Lin et al. ..... 382/167
6,157,747 A * 12/2000 Szeliski et al. ..... 382/284
6,163,363 A * 12/2000 Nelson et al. ..... 355/32
6,320,174 B1 * 11/2001 Tafas et al. ..... 250/208.1
6,370,175 B1 * 4/2002 Ikeda et al. ..... 372/38.1
6,463,173 B1 10/2002 Tretter
6,553,175 B2 * 4/2003 Jaspan ..... 385/140
6,771,320 B2 8/2004 Choi
6,992,718 B1 * 1/2006 Takahara ..... 348/333.09
7,029,127 B2 * 4/2006 Ogawa et al. ..... 353/84
7,118,226 B2 * 10/2006 Davis et al. ..... 353/84

(Continued)

FOREIGN PATENT DOCUMENTS

JP 2003149741 5/2003

(Continued)

OTHER PUBLICATIONS

Takashi Toyooka et al.: "12.3: Illumination Control System for Adaptive Dynamic Range Control" May 25, 2004. SOD International Symposium, Seattle, WA. DP007018825.

*Primary Examiner*—Prabodh M Dharia

(57) ABSTRACT

One embodiment of a display system includes a control module that controls a position of an adjustable neutral density filter based on a calculated filter setting and that controls modulation of a set of frame data by an image modulator based on a calculated gain setting, and an image analysis module that calculates a gain setting and a filter setting for the set of frame data and forwards the calculated gain setting and the filter setting to said control module.

20 Claims, 3 Drawing Sheets

U.S. PATENT DOCUMENTS

| | | | | |
|---|---|---|---|---|
| 7,280,125 | B2 * | 10/2007 | Sagano et al. | 345/690 |
| 2001/0021302 | A1 * | 9/2001 | Jaspan | 385/140 |
| 2001/0038717 | A1 * | 11/2001 | Brown | 382/284 |
| 2002/0159101 | A1 * | 10/2002 | Alderson et al. | 358/504 |
| 2003/0128000 | A1 | 7/2003 | Nakanishi | |
| 2003/0156188 | A1 * | 8/2003 | Abrams, Jr. | 348/51 |
| 2004/0012676 | A1 * | 1/2004 | Weiner et al. | 348/207.1 |
| 2004/0257386 | A1 * | 12/2004 | Sagano et al. | 345/690 |
| 2005/0041113 | A1 * | 2/2005 | Nayar et al. | 348/219.1 |
| 2005/0084175 | A1 * | 4/2005 | Olszak | 382/284 |
| 2005/0116893 | A1 * | 6/2005 | Joo | 345/60 |
| 2005/0156871 | A1 | 7/2005 | Ikeda | |
| 2006/0019709 | A1 * | 1/2006 | Kim et al. | 455/562.1 |
| 2006/0083299 | A1 * | 4/2006 | Kitajima | 375/240.01 |
| 2007/0013871 | A1 * | 1/2007 | Marshall et al. | 353/20 |
| 2007/0133868 | A1 * | 6/2007 | Hu | 382/167 |
| 2007/0133870 | A1 * | 6/2007 | Hu | 382/167 |
| 2007/0164944 | A1 * | 7/2007 | Meados et al. | 345/84 |
| 2008/0095467 | A1 * | 4/2008 | Olszak et al. | 382/284 |

FOREIGN PATENT DOCUMENTS

| | | |
|---|---|---|
| WO | 2005093703 | 10/2005 |

* cited by examiner

DISPLAY SYSTEM

Display systems may display a viewable image that does not effectively utilize the full dynamic range, fidelity and contrast ratio range of the display system. Improving the utilization of the dynamic range, fidelity and contrast ratio range of a display system may improve the viewable image displayed by the display system.

DETAILED DESCRIPTION OF THE DRAWINGS

Figure 1:
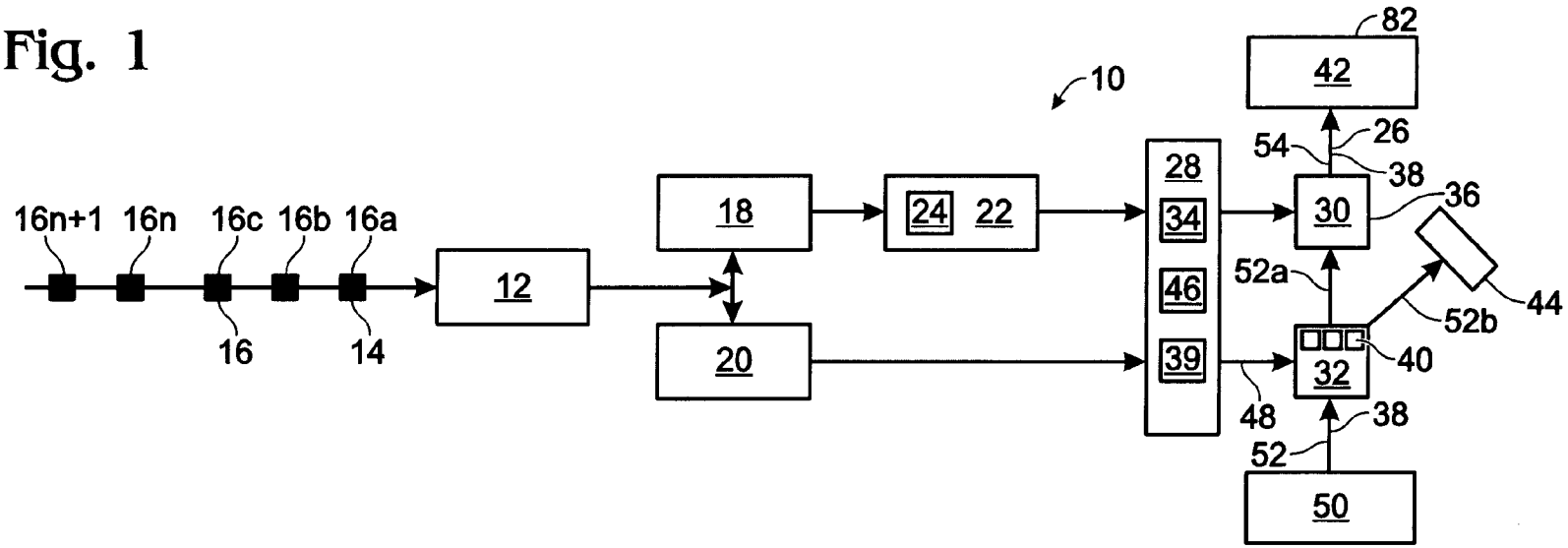
FIG. 1 represents a schematic view of a display system according to one embodiment of the present invention.

FIG. 1 represents a schematic view of a display system 10 according to one embodiment of the present invention. Display system 10 may include a data input module 12 that receives input data 14. Input data 14 may comprise an electronic video data stream including sequential sets of frame data, shown schematically as 16*a*, 16*b* and 16*c* through 16*n*+1. Each set of frame data 16 may include, for example, three color channels, such as red, blue and green (RBG). Each color channel may include eight bytes per channel, for example, which may yield 256 code values (zero to 255) per channel. The input data 14 may also include, for example, 124 mega pixels per frame of information transmitted at a speed of sixty frames per second. Accordingly, input data 14 may include large amounts of data input to data input module 12. In other embodiments, other types and amounts of data may be transmitted to data input module 1, for example, other color space, resolution, frame rate and bit depth values or types may be utilized.

Input module 12 may be electronically connected to both an image data capture module 18 and to a frame storage buffer module 20 such that input module 12 transmits input data 14, including a set of frame data 16, to both capture module 18 and to frame storage buffer module 20. Such transmission may be simultaneous or sequential, or a mixture thereof. In one embodiment, frame storage buffer module 20 may be utilized whereas in another embodiment, frame storage buffer 20 may not be utilized.

Image data capture module 18 may be electronically connected to an image analysis module 22 such that image data capture module 18 transmits input data 14, including set of frame data 16, to image analysis module 22. Image analysis module 22 may include machine operable instructions 24, such as software code. Instructions 24 may operate to analyze set of frame data 16 to determine a gain setting and a filter setting for set of frame data 16 to increase the dynamic range, fidelity and contrast ratio range of a set of displayed frame data 26 displayed by display system 10 and corresponding to set of frame data 16. In one embodiment, image analysis module 22 may calculate a gain setting as set forth in U.S. Pat. No. 6,463,173, issued on Oct. 8, 2002 to Daniel R. Tretter, assigned to Hewlett-Packard Company, and entitled SYSTEM AND METHOD FOR HISTOGRAM-BASED IMAGE CONTRAST ENHANCEMENT, wherein such patent is hereby incorporated in its entirety by reference herein.

Calculating a gain setting and a corresponding filter setting (see FIG. 2) may be conducted to enhance the final image projected by the projection system. In particular there are two main disadvantages associated with projection systems that do not utilize the gain and filter setting calculations of the present invention. The first disadvantage of prior art systems is that there may be unwanted light from the light modulator that contaminates the projected image and has a particularly severe impact on dark regions. The second main disadvantage is that the granularity of control of light modulation is usually fixed and may be linear, i.e., the total number of modulation levels may be distributed substantially equally across the total modulation range. Thus, a dark scene that uses a narrow part of the modulation range may only use a small number of discrete modulation levels. In many cases, this may lead to decreased fidelity of the viewable image.

Determining or calculating a gain setting or settings may be defined as applying a set of gain values to define a tone curve. The actual algorithm or algorithms utilized to calculate the gain setting, wherein many different types of algorithms may be utilized, may involve applying a different gain value to each individual pixel in the image based on the luminance value of the individual pixel. In one simple algorithm this may include applying a single, identical gain value to each pixel. More complex algorithms may involve applying hundreds or more slightly different gain values to the pixels, wherein each individual gain setting value is applied to a corresponding one of the different pixels. In many cases the algorithms attempt to match the average luminance of the frame to the attenuation factor applied by an adjustable filter 30 such that the overall luminance remains approximately constant. The single or multiple gain settings that may be applied to individual pixels of a frame are referred to collectively herein as a "gain" or a "gain setting" for that frame. Accordingly, a "gain setting" as defined herein may include one or more different gain settings applied to pixels of a single frame.

Filter 30, different embodiments of which are shown in FIGS. 3 through 7, for purposes of this specification, is defined as a neutral density filter, e.g., a filter manufactured of a material wherein light passing through the filter passes directly through the material itself. For example, the filter may be manufactured of a neutral density material such as glass wherein light passing through the filter passes through the glass material itself. The neutral density filter material may define a gradient therein, as shown in FIGS. 3-7. In contrast, in a mechanical filter, such as an adjustable iris, the light does not pass directly through the material of the filter leaves but instead some light impinging on the filter passes through an aperture created in the center of the iris and the remainder of the light impinging on the filter is blocked by the leaves of the iris. Accordingly, filter 30 of the present invention does not include mechanical iris type filters that define an adjustable aperture wherein light only passes through the filter at the open area of the iris but does not pass through the material of the leaves.

Image analysis module 22 may be electronically connected to a control module 28 that may be operatively connected to a filter 30 and to an image modulator 32. Control module 28 may include a mechanical motor 34 that mechanically moves filter 30 (see FIGS. 3-7) to position a particular light transmission region 36*a* (see FIGS. 3-7), for example, that corresponds to the filter setting calculated by image analysis module for a first set of frame data, within projection path 38. Thereafter motor 34 may move filter 30 to position another light transmission region 36*b*, for example, that corresponds to the filter setting calculated by image analysis module 22 for a corresponding another set of frame data, within projection path 38. Motor 34 may also position the filter such that a portion of one or more transmission regions, 36*b* and 36*c* for example, is positioned within projection path 38. Accordingly, filter 30 may be continually adjusted during transmission of a video image, for example, through display system 10 to control an amount of light transmitted along a projection path 38 wherein the sequential transmission of light through filter 30 corresponds to sequential sets of frame data, such as sets of data 16*a*, 16*b*, 16*c* through 16*n*+1. In other words, the amount of light transmitted through filter 30 may be adjusted by physically moving filter 30 such that the amount of light transmitted through filter 30 for a particular set of frame data corresponds to the gain setting applied to the set of frame data by control module 28. Accordingly, the filter or filters 30 can be applied in different manners. For example, in one embodiment the light beam may clearly and completely fall within a discrete light transmission region and, therefore, the overall transmission may be controlled entirely by the attenuation of the selected region, which may result in a very uniform transmission. In another embodiment the light beam and filter or filters may be aligned such that the light beam passes through two or more regions of different filter densities which may result in less uniformity of transmitted light, but a greater range of percent transmission values. In this second embodiment the overall percentage of light transmitted may be a function of multiple filter densities, the area of each light transmission region that the light beam passes through, and in, in the case of a non-uniform light beam, the energy density of the light impinging upon each filter region.

Control module 28 may also include a controller 39 that may electrostatically control individual pixels 40, for example, of image modulator 32. Image modulator 32 may include hundreds, thousands, or more, of individual pixels 40, such as movable micromirrors, which may each be controlled by controller 39 to move between an active or "on" state and an inactive or "off" state. In the "on" state an individual pixel 40 may be positioned to reflect light to an imaging region 42 and in the "off" state, an individual pixel 40 may be positioned to reflect light to a light dump 44.

Control module 28 may further include a controller 46 that may apply the gain setting calculated by image analysis module 22 to a set of frame data 16. In particular, frame storage buffer module 20 may be electronically connected to control module 28 such that frame storage buffer module 20 transmits a set of frame data 16 to control module 28. Controller 46 then applies the gain setting calculated by image analysis module 22 to set of frame data 16 and control module 28 thereafter transmits a second set of frame data 48 to image modulator 32, wherein second set of frame data 48 corresponds to set of frame data 16, having the gain setting applied thereto. In other words, the control module may receive the frame data and the gain data, apply the gain data to the frame data, and then pass the modified or second set of frame data 48 to the modulator 32.

Still referring to FIG. 1, display system 10 may further include a light source 50 that may project a light beam 52 along projection path 38, wherein light beam 52 may reflect off image modulator 32 and may extend through filter 30. Filter 30 may be positioned anywhere along projection path 38. In one embodiment, filter 30 may be positioned in an end region 54 of projection path 38, such as downstream of image modulator 32. In other embodiments filter 30 may be placed between light source 50 and image modulator 32 or between image modulator 32 and imaging region 42. End region 54 of display system 10 may include an optical system, such as a projection lens set (not shown), as will be understood by those skilled in the art.

Figure 2:
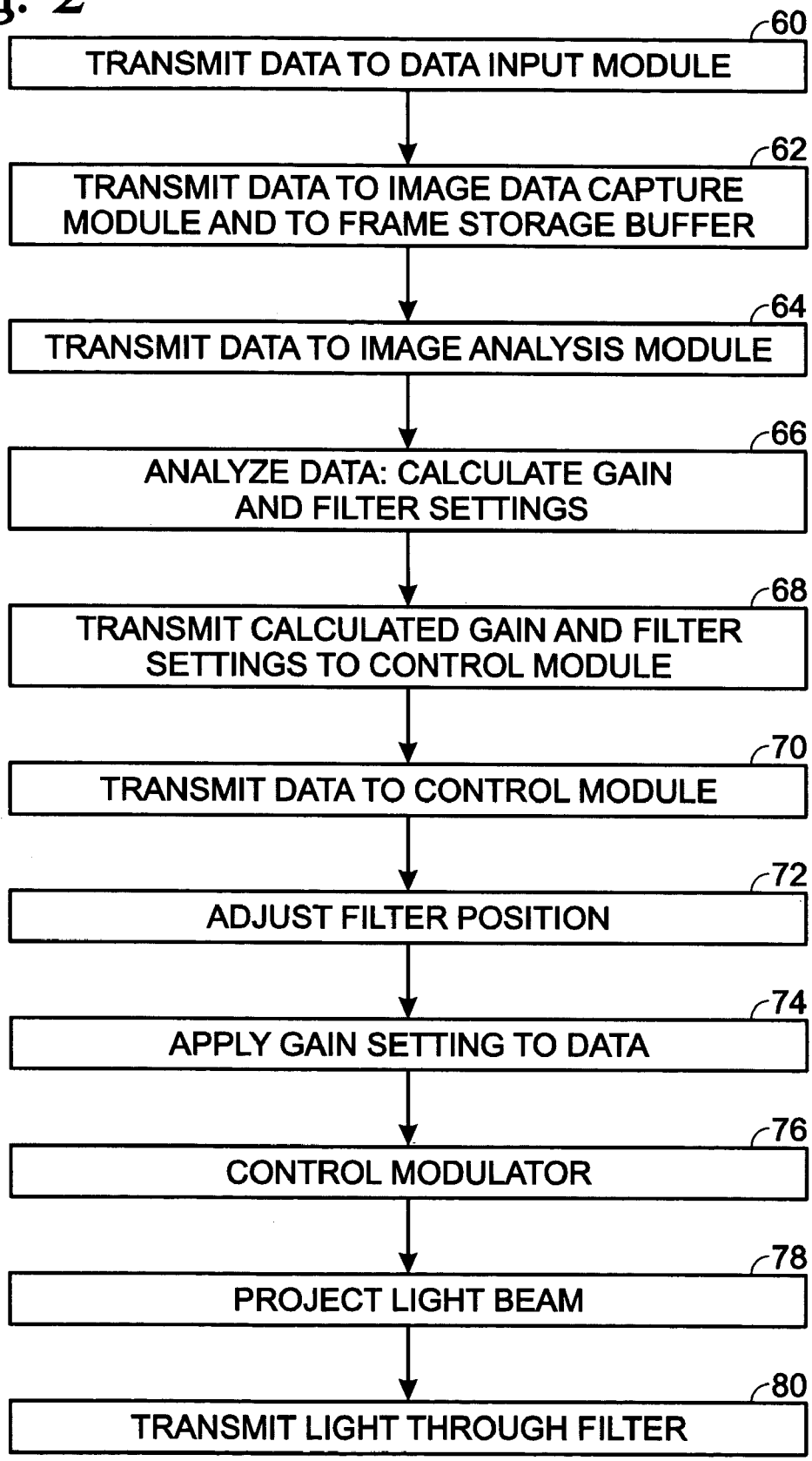
FIG. 2 is a flowchart of a method of making a display system according to one embodiment of the present invention.

FIG. 2 is a flowchart of a method according to one embodiment of the present invention. In step 60 a set of frame data 16 may be transmitted to data input module 12. Set of frame data 16 may be part of a video stream of data, for example, such as a live broadcast, a video, a computer monitor display, or the like.

In step 62 data input module 12 transmits set of frame data 16 to both image data capture module 18 and to frame storage buffer module 20. Set of frame data 16 is stored within frame storage buffer module 20 during calculation by image analysis module 22.

In step 64 image data capture module 18 transmits set of frame data 16 to image analysis module 22.

In step 66, image analysis module 22 analyzes set of frame data 16 and calculates a corresponding gain setting and a corresponding filter setting that may increase utilization of the dynamic range, fidelity and contrast ratio of a display to improve the viewable image displayed by the display system 10. The method of calculating the gain setting, in one embodiment, is set forth in U.S. Pat. No. 6,463,173, issued on Oct. 8, 2002 to Daniel R. Tretter, listed above. In one example, the calculated gain setting may be ×2, i.e., the value of the data set for one frame of pixels is doubled (×2) such that the human eye can more easily perceive contrast differences between individual pixels, compared to the unmodified data set. A filter setting of 50% may correspond to a gain setting of ×2, i.e., fifty percent less light is transmitted through the filter. In such an example, the individual pixels having a higher gain value and a corresponding amount of less light transmitted through the filter result in the overall luminance of the frame remaining approximately the same. In another embodiment wherein individual pixels may each have their own unique gain value, an average of the gain values for all the pixels may be calculated to determine a corresponding filter setting that will result in the overall luminance of the frame remaining approximately the same. In other words, the tone map gain of the image may be averaged in order to calculate a corresponding single filter setting. In still another embodiment, the tone map gain of the image may correspond to individual filter settings within a single filter for a photochromic filter that may change its density according to a level of light incident on individual regions of the filter.

In step 68 image analysis module 22 transmits the calculated gain setting and the calculated filter setting to control module 28.

In step 70 frame storage buffer module 20 transmits set of frame data 16 to control module 28.

In step 72 control module 20 operates mechanical motor 34 to position a region 36 of filter 30 within projection path 38 to correspond to the filter setting calculated in step 66.

In step 74 control module 20 operates controller 46 to apply the calculated gain setting to set of frame data 16 to form second set of frame data 48, wherein second set of frame data 48 is set of frame data 16 having the calculated gain setting applied thereto. As discussed previously, the calculated "gain setting" may include a unique gain value for each pixel of the modulator array for each individual set of frame data. Accordingly, the gain setting calculated in step 66 may be applied to the set of frame data 16 from which the gain setting was calculated, instead of to a subsequent set of frame data. Applying the calculated gain setting to the set of frame data 16 from which the gain setting was calculated may increase the quality of the viewable image projected from display system 10 because there is a direct correlation between the gain setting and the data to which it is applied. Applying a gain setting to a completely different set of data from which the gain setting was calculated may not provide an improved contrast ratio within the image because the gain setting may be inapplicable to the data. In the embodiment shown herein, the gain setting and the filter setting may be applied to the set of frame data 16 from which the settings were calculated, or the settings may be applied to a subsequent set of frame data.

In step 76 control module 20 operates controller 39 to position each of individual pixels 40 of image modulator 32 in a desired "on" or "off" position, based on the information contained with second set of frame data 48, which corresponds to set of frame data 16 having the calculated gain setting applied thereto.

In step 78 light source 50 projects light beam 52 along projection path 38 and toward image modulator 32. Individual activated ones of pixels 40 reflect corresponding portions of light beam 52 as a reflected light beam 52*a* along projection path 38. An unused portion 52*b* of light beam 52 that is reflected by unactivated ones of pixels 40 is reflected to light dump 44.

In step 80 reflected light beam 52*a* is transmitted through transmission region 36 of filter 30 and to imaging region 42 to provide a viewable image 82 having improved utilization of the dynamic range, fidelity and contrast ratio range of display system 10 such that viewable image 82 may have improved contrast when compared to an image projected by a display system that does not utilize a gain setting and a filter setting of the present invention. Moreover, viewable image 82 may be created utilizing a gain setting and a filter setting that are calculated based on the set of frame data that was utilized to create viewable image 82. Accordingly, there may be a direct correlation between the gain and the filter settings and the image itself. In this manner, an improved viewable image is consistently and continuously provided having contrast differences that are more discernable to the human eye than images having gain and filter settings calculated for a previous set of frame data. In other embodiments the gain and filter settings may be calculated for a first set of frame data and then applied to a second set of frame data.

The process may then be repeated, beginning at step 60, for subsequent sets of frame data, in a looping or continuous manner.

Figure 3:
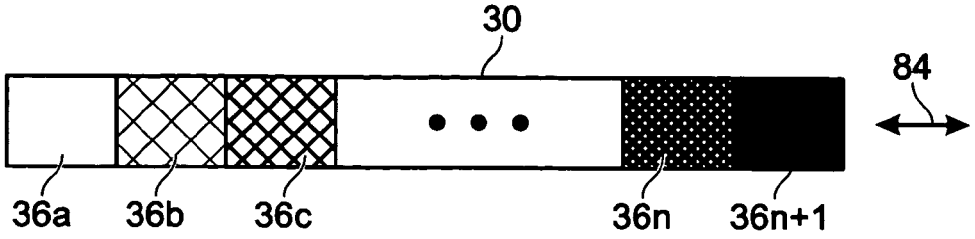
FIG. 3 represents a schematic front view of a filter according to one embodiment of the present invention.

FIG. 3 shows a schematic front view of a rectangular slide optical filter 30 according to one embodiment of the present invention. Optical filter 30 is a discrete stepped gradient filter and includes a plurality of transmission regions 36, individually labeled 36*a*, 36*b*, and so on, up to 36*n*+1, that each define a light transmission percentage. For example, region 36*a* may define a light transmission percentage of 100%, which may indicate that all light transmitted to region 36*a* will be transmitted. Region 36*b* may define a light transmission percentage of 95%, which may indicate that 95% of all light transmitted to region 36*b* will be transmitted and 5% of the light will not be transmitted. Region 36*c* may define a light transmission percentage of 90%, which may indicate that 90% of all light transmitted to region 36*c* will be transmitted and 10% of the light will not be transmitted, and so on. Region 36*n*+1 may define a light transmission percentage of 0%, which may indicate that 0% of all light transmitted to region 36*n*+1 will be transmitted and 100% of the light will not be transmitted.

A size of each of light transmission regions 36 may be larger than a cone of light or cross-sectional size of light beam 52 such that when light beam 52 is projected toward one of light transmission regions 36, the entirety of light beam 52 impinges on a single of light transmission regions, such as 36*a*, 36*b*, or the like. Filter 30 may be controlled by control module 28 to move linearly along an axis of movement 84 so as to position a transmission region 36, or one or more portions of light transmission regions 36, within projection path 38.

Figure 4:
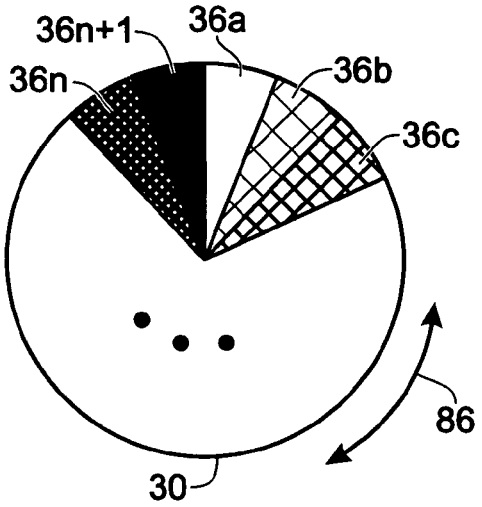
FIG. 4 represents a schematic front view of another filter according to one embodiment of the present invention.

FIG. 4 shows a schematic front view of a circular optical filter 30 according to one embodiment of the present invention. Optical filter 30 includes a plurality of transmission regions 36, individually labeled 36*a*, 36*b*, and so on, up to 36*n*+1, that each define a light transmission percentage. Region 36*a* may define a light transmission percentage of 100%, which may indicate that all light transmitted to region 36*a* will be transmitted. Region 36*b* may define a light transmission percentage of 95%, which may indicate that 95% of all light transmitted to region 36*b* will be transmitted and 5% of the light will not be transmitted. Region 36*c* may define a light transmission percentage of 90%, which may indicate that 90% of all light transmitted to region 36*c* will be transmitted and 10% of the light will not be transmitted, and so on. Region 36*n*+1 may define a light transmission percentage of 0%, which may indicate that 0% of all light transmitted to region 36*n*+1 will be transmitted and 100% of the light will not be transmitted. A size of each of light transmission regions 36 may be larger than a cone of light or cross-sectional size of light beam 52 such that when light beam 52 is projected toward one of light transmission regions 36, the entirely of light beam 52 impinges on a single of light transmission regions, such as 36*a*, 36*b*, or the like. Filter 30 may be controlled by control module 28 to rotationally move along a direction of movement 86 so as to position a transmission region 36, or one or more portions of light transmission regions 36, within projection path 38.

Figure 5:
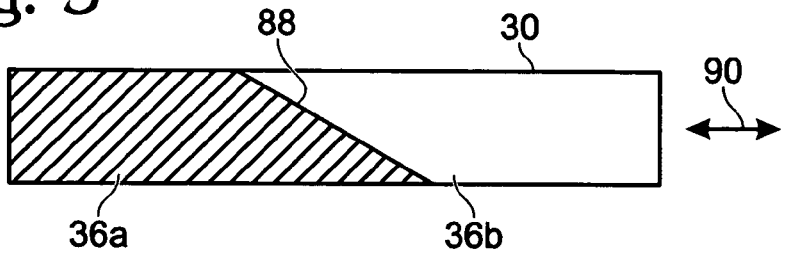
FIG. 5 represents a schematic front view of another filter according to one embodiment of the present invention.

FIG. 5 shows a schematic front view of a rectangular slide optical filter 30 according to one embodiment of the present invention. Optical filter 30 includes two transmission regions 36, individually labeled 36*a* and 36*b*, that each define a light transmission percentage. Region 36*a* may define a light transmission percentage of 50%, which may indicate that 50% of all light transmitted to region 36*a* will be transmitted and 50% of the light will not be transmitted. Region 36*b* may define a light transmission percentage of 100%, which may indicate that 100% of all light transmitted to region 36*b* will be transmitted and that no light will be blocked from transmitting therethrough. A size of each of light transmission regions 36 may be larger than a cone of light or cross-sectional size of light beam 52 such that when light beam 52 is projected toward one of light transmission regions 36, the entirety of light beam 52 impinges on a single of light transmission regions, such as 36*a* or 36*b*. The interface 88 between regions 36*a* and 36*b* may be angled such that as filter 30 is controlled by control module 28 to move linearly along an axis of movement 90, the filter may be positioned with a portion of region 36*a* and a portion of 36*b* positioned with projection path 38.

Still referring to FIG. 5, the rectangular filter 30 shown in FIG. 5 may be oriented vertically such that 100% transmission region 36*b* is positioned in an upper region of the filter and 50% transmission region 36*a* is positioned in a lower region of filter 30. Such an orientation of a gradient filter may be termed a spatially varying "bright sky/dark ground" filter because less filtering may occur in a typical "sky" region of an image and more filtering may occur in a typical "ground" region of an image. In such an embodiment interface 88 may be a horizontal line which may be positioned at any vertical position along filter 30 to provide the desired filtering characteristics.

In still another embodiment, there may be no interface 88 but instead filter 30 may define a continuous gradient of filtering transmission percentages wherein a lower transmission percentage is positioned in a lower or "ground" region of the filter and a higher transmission percentage is positioned in a higher or "sky" region of the filter. In such an embodiment, the gain value of individual pixels positioned in an upper or "sky" region of an image may be less than the gain value of individual pixels positioned in a lower or "ground" region of an image. Such a gradient of gain values is an example of a spatially varying gain. Another spatially varying gain that may be applied is one based on a retinex-like process, whereby the gain applied to a pixel depends at least partly on the values of the surrounding pixels.

Figure 6:
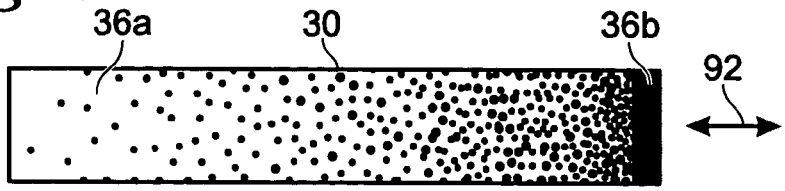
FIG. 6 represents a schematic front view of another filter according to one embodiment of the present invention.

FIG. 6 represents a schematic front view of another rectangular optical filter 30 according to one embodiment of the present invention. Optical filter 30 may include continuous gradient transmission region 36, which may include a first end region 36*a* and a second end region 36*b*. The continuous gradient nature of filter 30 in this embodiment is schematically illustrated by a density of stippling that increases from first end region 36*a* to second end region 36*b*. First end region 36*a* may define a light transmission percentage of approximately 100%, which may indicate that 100% of all light transmitted to region 36*a* will be transmitted and 0% of the light will not be transmitted. Second end region 36*b* may define a light transmission percentage of 0%, which may indicate that 0% of all light transmitted to region 36*b* will be transmitted and 100% of the light will not be transmitted. A size of each of light transmission regions 36*a* and 36*b* may be larger than a cone of light or cross-sectional size of light beam 52 such that when light beam 52 is projected toward one of light transmission regions 36, the entirely of light beam 52 impinges on a single of light transmission regions, such as 36*a* or 36*b*. Even a slight movement of filter 30 along axis of movement 92, as controlled by control module 28, may alter the transmission percentage of light that is transmitted through the filter.

Figure 7:
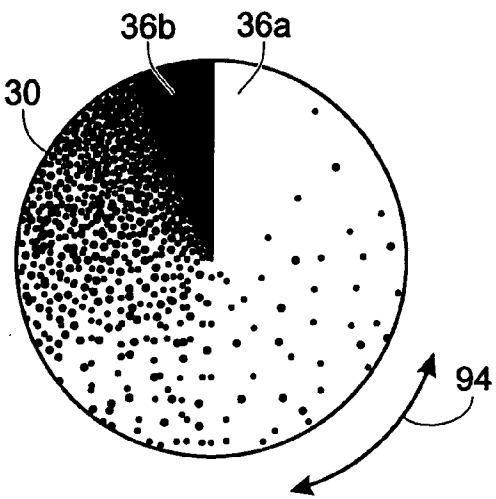
FIG. 7 represents a schematic front view of another filter according to one embodiment of the present invention.

FIG. 7 represents a schematic front view of another circular optical filter 30 according to one embodiment of the present invention. Optical filter 30 may include a continuous gradient transmission region 36, which may include a first end region 36*a* and a second end region 36*b*. The continuous gradient nature of filter 30 in this embodiment is schematically illustrated by a density of stippling that increases rotationally from first end region 36*a* to second end region 36*b*. First end region 36 may define a light transmission percentage of approximately 100%, which may indicate that 100% of all light transmitted to region 36*a* will be transmitted and 0% of the light will not be transmitted. Second end region 36*b* may define a light transmission percentage of 0%, which may indicate that 0% of all light transmitted to region 36*b* will be transmitted and 100% of the light will not be transmitted. A size of each of light transmission regions 36*a* and 36*b* may be larger than a cone of light or cross-sectional size of light beam 52 such that when light beam 52 is projected toward one of light transmission regions 36, the entirety of light beam 52 impinges on a single of light transmission regions, such as 36*a* or 36*b*. Even a slight movement of filter 30 around direction of movement 94, as controlled by control module 28, may alter the transmission percentage of light that is transmitted through the filter.

As stated above, filter 30 of the present invention includes filters having a neutral density filter material through which the light directly passes, but does not include mechanical filters such adjustable iris filters wherein the light passes through an aperture defined by the filter material. The advantages of using a neutral density filter are numerous, including reducing image non-uniformity due to interactions between gradients in light density of the light bundle and the shape or position of the aperture. Alignment tolerances may also be increased, thereby reducing non-uniformity resulting from misalignment of mechanical filters. For example, while ideal light bundles are equally uniform, many systems are not ideal, with the result that there may be gradients in the light density at various points in the optical path. Previous methods utilize adjustable mechanical apertures which have been known to introduce image artifacts due to the shape of the aperture and how it interacts with gradients in the light density. These artifacts tend to be non-linear and may result in a decrease of uniformity over the image, which may be worse when the aperture is nearly or completely closed. Conversely, a neutral density filter affects all regions of the image without blocking localized regions that may be high or low intensity and therefore may result in greater image uniformity over the operating range.

Previous implementations using mechanical apertures may be smaller than the light beam and, therefore, may block portions of the light beam from transmitting therethrough. Such previous implementations may require precise alignment of the aperture with the optical beam. Errors in alignment, particularly in systems that have gradients in the light density of the light beam, can result in non-uniform images. Conversely, a neutral density filter can be sized larger than the light beam, which may provide greater alignment tolerances and may reduce non-uniformity of the image resulting from alignment errors.

Moreover, by utilizing a neutral density filter in conjunction with applying a gain factor to the image codes values, the overall dynamic range and contrast ratio of the system can be increased. For example, the overall image quality may be enhanced for scenes that are predominantly dark by increasing the contrast ratio between pixel values to utilize more of the dynamic range available. In other words, the overall black point of an image can be reduced, thus resulting in better image quality as perceived by the human eye.

Furthermore, use of an optical filter that extends throughout a cross section or cone of light beam 52 may reduce distortion of the light beam as it passes therethrough because the filter may equally effect the entire light cone equally or approximately equally. Additionally, the lower the transmission rate of light through the filter, the higher the gain setting that may be applied to the set of frame data. In other words, the light beam 52 is passes through optical filter 30 which may reduce the amount of light beam 52 that is transmitted therethrough. Accordingly, a higher gain is added to the color code values, which the light modulator maybe able to produce more accurately then lower color code values. In this manner, the overall luminance of the viewable image may remain the same as that of a set of frame data in which a gain is not added and which is not passed through a filter. However, the set of frame data in which a gain is added and which is passed through a filter may have the same overall luminance but may be more visibly clear or crisp to the human eye.

The foregoing description of embodiments of the invention have been presented for purposes of illustration and description. It is not intended to be exhaustive or to limit the invention to the precise form disclosed, and modifications and variation are possible in light of the above teachings or may be acquired from practice of the invention. The embodiments were chosen and described in order to explain the principles of the invention and its practical application to enable one skilled in the art to utilize the invention in various embodiments and with various modification as are suited to the particular use contemplated. It is intended that the scope of the invention be defined by the claims appended hereto and their equivalents.

We claim:

1. A display system, comprising:

a control module that controls a position of an adjustable neutral density filter based on a calculated filter setting and that controls modulation of a set of frame data by an image modulator based on a calculated gain setting; and an image analysis module that calculates a gain setting and a filter setting for said set of frame data and forwards said calculated gain setting and said filter setting to said control module.

2. The system of claim 1 further comprising a frame data buffer that stores said set of frame data during calculation by said image analysis module.

3. The system of claim 1 further comprising an image modulator that receives said set of frame data from said frame data buffer, receives said calculated gain setting from said control module, and outputs a set of viewable image data, wherein said set of viewable image data comprises said set of frame data having said calculated gain setting applied thereto.

4. The system of claim 1 further comprising a movable neutral density filter that is mechanically moved to a position that corresponds to said calculated filter setting by said control module to adjust an amount of light output therethrough, wherein said filter is positioned within a projection path of said system.

5. The system of claim 1 further comprising an image data capture module that receives said set of frame data and forwards said set of frame data to said image analysis module.

6. The system of claim 5 further comprising an input module that forwards said set of frame data to said image data capture module and to said frame data buffer.

7. The system of claim 1 wherein said image analysis module calculates a gain setting and a filter setting for sequential sets of frame data and sequentially forwards a calculated gain setting and a filter setting to said control module for each of said sequential sets of frame data.

8. The system of claim 7 wherein said sequential sets of frame data comprise a video input.

9. The system of claim 1 wherein said image analysis module calculates said gain setting and said filter setting to increase a contrast ratio between pixel values of said set of frame data.

10. The system of claim 1 wherein said calculated gain setting and said calculated filter setting are applied by said control module to said set of frame data from which said calculated gain setting and said calculated filter setting are calculated.

11. A method of controlling a contrast ratio of an image, comprising:

receiving an image frame data;

conducting an image analysis of said image frame data by an image analysis module to calculate a gain setting and a filter setting;

applying said gain setting to said image frame data to control a contrast ratio of said image frame data;

adjusting an optical neutral density filter to correspond to said gain setting; and projecting light through said filter, wherein said light corresponds to said image frame data having said gain setting applied thereto.

12. The method of claim 11 further comprising reflecting said light from an image modulator, wherein said filter is positioned in a position chosen from one of downstream of said image modulator and upstream of said modulator.

13. The method of claim 11 wherein said applying said gain setting to said image frame data to control a contrast ratio of said image frame data comprises altering said image frame data with said gain setting to define a viewable frame data.

14. The method of claim 13 further comprising displaying said viewable frame data on an imaging region.

15. The method of claim 12 wherein said image modulator comprises a digital micromirror array.

16. The method of claim 11 wherein said conducting an image analysis of said image frame data by said image analysis module to calculate a gain setting comprises executing machine operable computer instructions to increase an overall dynamic range and fidelity of light utilized by said image frame data.

17. An image projection apparatus, comprising:

an image modulator that outputs light corresponding to a set of viewable image data having a controlled contrast ratio;

a set of machine operable instructions that calculates a gain setting from a set of frame data, wherein said gain setting is applied to said set of frame data to produce said set of viewable image data; and a set of machine operable instructions that calculates a filter light transmission setting that is applied to light output from said modulator to produce said viewable image, wherein said filter light transmission setting and said gain setting together define said viewable image data having a luminance value substantially similar to a luminance value of said set of frame data.

18. The apparatus of claim 17 further comprising an adjustable optical neutral density filter and a controller that adjusts a position of said adjustable filter to correspond to said filter light transmission setting, wherein said optical filter is chosen from one of the group consisting of a slide filter and a rotational filter, and is chosen from one of the group consisting of a discrete stepped gradient filter and a continuous gradient filter.

19. The apparatus of claim 17 further comprising a controller that applies said gain setting to said set of frame data.

20. The apparatus of claim 17 further comprising a light source that produces a light beam that is reflected by said image modulator to produce said viewable image.

* * * * *